United States Patent [19]

Bacharach

[11] Patent Number: 4,465,240

[45] Date of Patent: Aug. 14, 1984

[54] BOWL MILL PULVERIZER

[75] Inventor: Ottmar Bacharach, Kaiserslautern/Pfalz, Fed. Rep. of Germany

[73] Assignee: Gebr. Pfeiffer AG, Fed. Rep. of Germany

[21] Appl. No.: 349,456

[22] Filed: Feb. 17, 1982

[30] Foreign Application Priority Data

Feb. 21, 1981 [DE] Fed. Rep. of Germany ..... 3106546

[51] Int. Cl.[3] ..... B02C 4/32; B02C 15/00

[52] U.S. Cl. ..... 241/121; 241/290

[58] Field of Search ..... 241/117–122, 241/286, 290

[56] References Cited

U.S. PATENT DOCUMENTS 4,147,308 4/1979 Mikkelsen ..... 241/117

4,382,558 5/1983 Svensson ..... 241/121 X 4,382,561 5/1983 Andersen et al. ..... 241/121

FOREIGN PATENT DOCUMENTS 2839815 3/1980 Fed. Rep. of Germany ..... 241/121

*Primary Examiner*—Mark Rosenbaum

*Attorney, Agent, or Firm*—Toren, McGeady and Stanger

[57] ABSTRACT

A bowl mill pulverizer includes a mill housing supported on and extending upwardly from a foundation. A milling bowl is supported within the housing for rotation about a vertical axis. A frame is located over the bowl with arms extending downwardly from the frame and rotatably supporting grinding rolls positioned within the bowl. Upwardly extending pull rods are secured at their upper ends to the frame and at their lower ends to the foundation. The pull rods press the grinding rolls downwardly against the bowl. The pull rods are disposed at an angle to the vertical and slope outwardly and downwardly toward the foundation.

4 Claims, 2 Drawing Figures

BOWL MILL PULVERIZER

SUMMARY OF THE INVENTION

The present invention is directed to a bowl mill pulverizer with a grinding or milling bowl positioned in a mill housing so that it rotates about a vertical central axis. A stationary structure dependently supports the milling rolls so that they are pressed against the milling bowl. The stationary structure includes a frame with depending arms rotatably supporting the grinding rolls. To press the frame, arms and rolls downwardly against the milling bowl, pull rods are secured to and extend downwardly from the frame and their lower ends are secured to hydraulic cylinders or the like which provide the requisite pressing effect.

In additional to the vertical or approximately vertical pulling forces effected on the frame through the pull rods, there are forces acting in a horizontal plane caused by the milling process and by the forces arising from it. Accordingly, because of the torque developed in the circumferential direction of the frame, forces are generated which must somehow be absorbed.

In known bowl mill pulverizers, so-called guideways are used to absorb such forces and they serve as abutments for the frame. If the frame, as viewed in plan, has the shape of an equilateral triangle, with an arm for each guiding roll extending downwardly from each side of the triangle, and if the mill housing is formed in the shape of an equilateral hexagon, such guideways are located in the corners of the mill housing associated with the corners of the frame. As a result, any forces which arise must be routed to the mill foundation in a relatively complicated manner via guideways and by passing through the mill housing. This is also true in another known embodiment, in which, instead of the aforementioned guideways, pull rods are provided which extend horizontally and are supported at the mill housing through the interposition of pressure-equalizing devices. The pull rods are connected to the corners of the frame.

Therefore, it is the primary object of the present invention, using an arrangement which is as simple as possible, to divert the forces resulting from the grinding process directly into the mill foundation and thereby avoid any additional structure and, in particular, any additional loading on the mill housing.

In accordance with the present invention, the force is diverted by pull rods, known per se, which are connected at their lower ends to hydraulic cylinders. The pull rods transmit from the frame forces developed in the milling process developed by the pressure of the milling rolls acting on the milling bowl. The pull rods are inclined to the vertical by an amount depending on the torque developed and the forces generated by the torque.

By the inclined arrangement of the pull rods, extending downwardly and outwardly from the frame, the forces generated by the torque developed by the milling process can be transmitted directly into the mill foundation. Such dynamic forces occurring during the milling operation do not have any effect, since they are absorbed by the cushioning or damping effect afforded by the spring travel distance of the hydraulic cylinders. Accordingly, the mill housing can be of a light construction, since it is relieved of the transmission of such forces. Any additional constructions are cancelled out.

The various features of novelty which characterize the invention are pointed out with particularity in the claims annexed to and forming a part of this disclosure. For a better understanding of the invention, its operating advantages and specific object attained by its use, reference should be had to the accompanying and descrptive matter in which there are illustrated and described preferred embodiments of the invention.

DETAIL DESCRIPTION OF THE INVENTION

Figure 1:
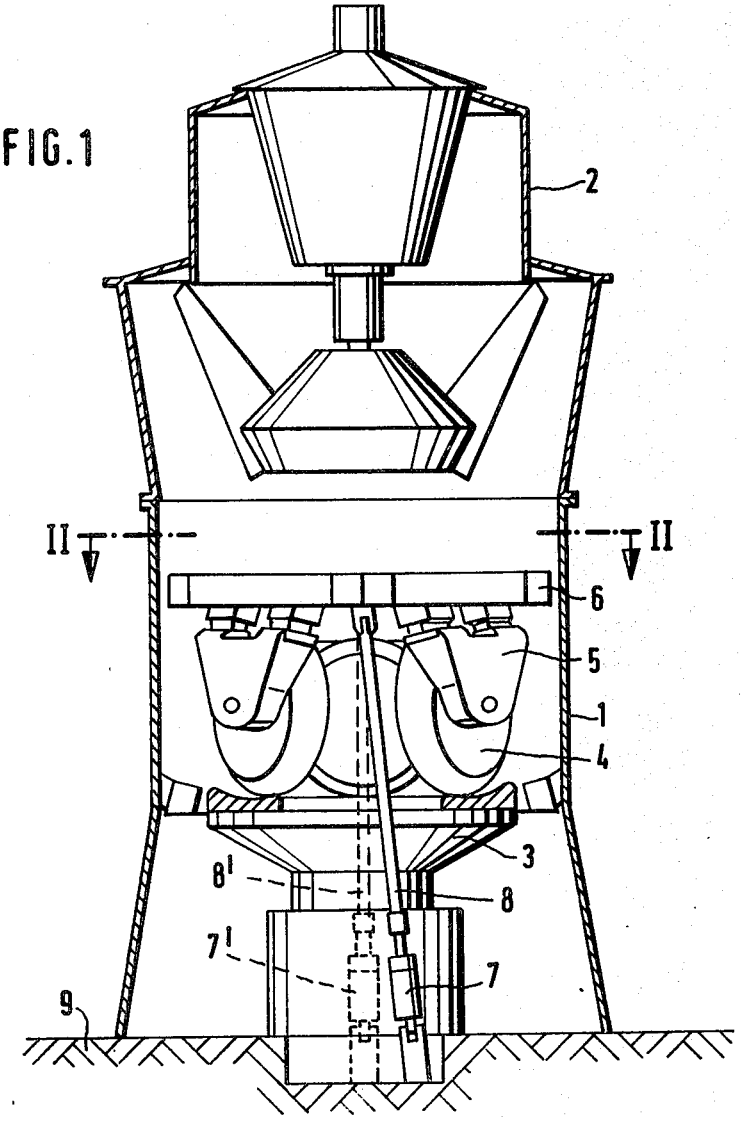
FIG. 1 is a schematic side view of a bowl mill pulverizer embodying the present invention and illustrating one of the pull rods.

In FIG. 1 an upwardly extending mill housing 1 has a screen 2 located at its upper end in a known manner. A milling bowl 3 is located within the housing and rotates about the vertical central axis of the mill. Milling rolls 4 contact and rotate on the milling bowl with the rolls rotating about horizontal axles supported by arms 5 depending downwardly from a pressure frame 6. Frame 6 transmits the necessary milling pressure to the milling rolls with the pressure being generated by hydraulic cylinders 7 secured to the lower ends of pull rods 8 which are secured to the frame 6 and pull it downwardly.

Figure 2:
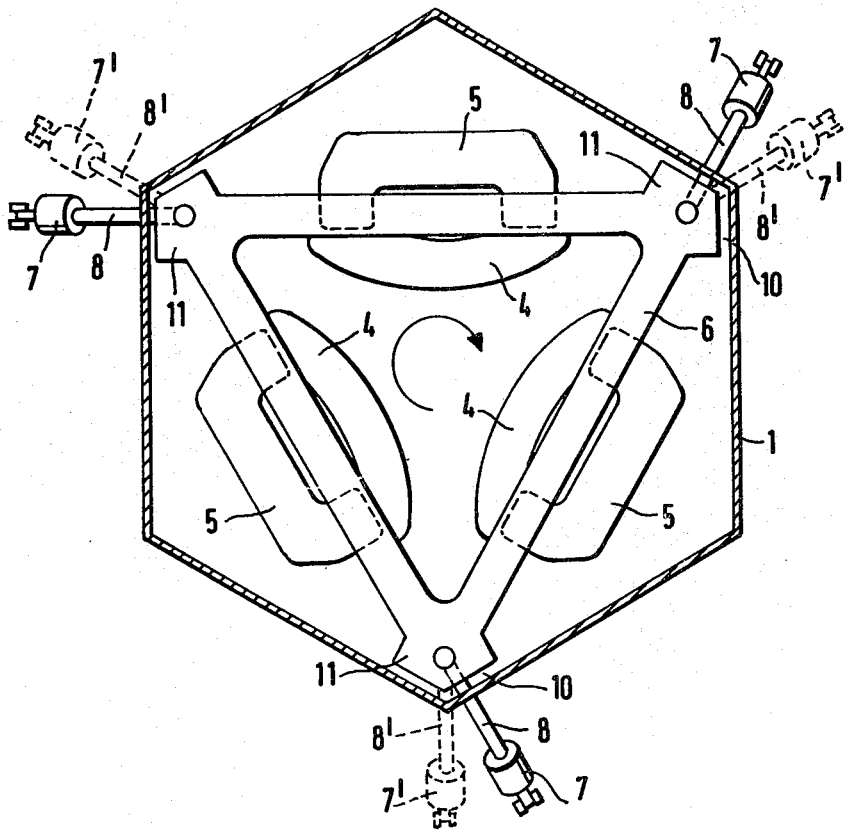
FIG. 2 is a schematic sectional view, on a somewhat enlarged scale, taken along the line II—II in FIG. 1.

As can be seen in FIG. 2, the frame 6 extends horizontally and has the shape of an equilateral triangle. The mill housing 1 laterally enclosing the frame has the shape of an equilateral hexagon with the corners of the frame being located in every other corner of the hexagonal housing. In known mills of this general type, pull rods 8 have been used disposed in the position 8' illustrated in dashed lines in FIGS. 1 and 2 and acted upon by the hydraulic cylinders 7'. The upwardly extending axis of the pull rod position 8' approximately bisects the angle formed by the two sides of the frame from which it depends. As a result, pull rods in the position 8' were able to absorb only the forces acting in the vertical direction, but not the horizontal components of the forces caused by torque generated in the milling process.

As can be seen in FIG. 2, the torque acts in the clockwise direction, note the arrow, and such forces must be diverted into the mill foundation 9. In the simplest previously known arrangements, such diversion was effected by so-called guideways arranged in the corner areas 10 of the mill housing 1. The corner areas 10 correspond to the corners 11 of the pressure frame 6. More expensive constructions using additional pull rods were also known.

In the present invention the horizontal components of the torque forces are diverted directly into the mill foundation, in a simple structural arrangement which relieves the mill housing. The diversion of the horizontal components of the forces into the mill foundation 9 is effected by positioning the pull rods 8, as shown in solid lines in FIGS. 1 and 2. As distinguished from the position 8' of the known pull rods, the pull rod 8, shown in solid lines, extend approximately in a plane including the center line of one leg of the equilateral triangularly shaped frame 6. The pull rod 8 is secured to the upstream end of the leg of the frame 6, relative to the clockwise direction of rotation as shown in FIG. 2, with which it is in general alignment. As can be seen in FIG. 2 each of the pull rods 8 is in general alignment with the center line of a different one of the legs of the frame 6. It can be noted that the position 8' of the previously known pull rods do not extend in the direction along one of the legs of the frame but along the bisector of the angle formed between two adjacent legs. With this arrangement of the pull rods 8 the horizontal force components can be diverted directly into the mill foundation 9 in a structurally simple manner which relieves the mill housing 1. The inclined position of the pull rods 8 depends on the magnitude and direction of the torque developed.

While specific embodiments of the invention have been shown and described in detail to illustrate the application of the inventive principles, it will be understood that the invention may be embodied otherwise without departing from such principles.

I claim:

1. Bowl mill pulverizer comprising a foundation, a mill housing supported on and extending upwardly from said foundation, a milling bowl mounted in said housing for rotation about a vertical axis, milling rolls, stationary means located within said mill housing for supporting said milling rolls, said stationary means including a frame spaced upwardly from said bowl and free of contact with said mill housing, arms attached to and depending downwardly from said frame and rotatably supporting said milling rolls on said milling bowl, and pressing means attached to said frame and pressing said frame, arms and rolls downwardly so that said rolls press against said milling bowl, said frame having at least three sides with said sides intersecting and forming corners of said frame, each of said at least three sides having a centerline extending between a pair of the corners of said frame, said pressing means comprises pull rods each attached to one corner of said frame with said pull rods inclined to the vertical and extending downwardly and outwardly from said frame and secured to said foundation, with each said pull rod located in a vertical plane including the centerline of one of said sides of said frame forming the corner from which said pull rod depends.

2. Bowl mill pulverizer, as set forth in claim 1, wherein said frame extends horizontally and has the shape of an equilateral triangle, one said pull rod connected to each said corner of said triangularly shaped frame, each side of said frame having a trailing end and a leading end in the rotational direction of said bowl about the vertical axis, each said pull rod is located at the trailing end of a different one of said sides.

3. Bowl mill pulverizer, as set forth in claim 2, including a hydraulic cylinder secured to the lower end of each said pull rod and said hydraulic cylinder secured to said foundation.

4. Bowl mill pulverizer, as set forth in claim 3, wherein said mill housing in horizontal section has the shape of an equilateral hexagon and the corners of said triangularly shaped frame are located in alternating interior corners of said mill housing.

* * * * *